US006682377B2

(12) United States Patent
Ishikawa et al.

(10) Patent No.: US 6,682,377 B2
(45) Date of Patent: Jan. 27, 2004

(54) PROPULSION APPARATUS FOR A VESSEL

(75) Inventors: Satoru Ishikawa, Nagasaki (JP); Toshinobu Sakamoto, Nagasaki (JP); Tetsuji Hoshino, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/174,950

(22) Filed: Jun. 20, 2002

(65) Prior Publication Data

US 2003/0003821 A1 Jan. 2, 2003

(30) Foreign Application Priority Data

Jun. 29, 2001 (JP) ..... P2001-199417

(51) Int. Cl.[7] ..... B63H 1/18
(52) U.S. Cl. ..... 440/66
(58) Field of Search ..... 440/66

(56) References Cited

U.S. PATENT DOCUMENTS 4,470,364 A * 9/1984 Kitaura et al. ..... 440/66
5,505,642 A * 4/1996 Theophanides ..... 440/66

FOREIGN PATENT DOCUMENTS

| | | | |
|---|---|---|---|
| JP | 4-212695 | * | 4/1992 |
| JP | 6-56082 | * | 6/1994 |
| JP | 9-240586 | * | 9/1997 |

* cited by examiner

*Primary Examiner*—Stephen Avila
(74) *Attorney, Agent, or Firm*—Wenderoth, Lind & Ponack, L.L.P.

(57) ABSTRACT

A propulsion apparatus for a vessel includes a main screw and a push type POD propeller which is provided rearward of the main screw. Furthermore, a plurality of grooves which extend along flow directions of a hub vortex generated by the main screw are provided on a front end portion of a casing of the POD propeller. According to this propulsion apparatus for a vessel, the hub vortex generated by the main screw rearward of the main screw is weakened by diffusing the hub vortex along the grooves, and therefore the propulsion efficiency of the propulsion apparatus for a vessel is improved.

4 Claims, 5 Drawing Sheets

PROPULSION APPARATUS FOR A VESSEL

BACKGROUND OF THE INVENTION

1. Field of the Invention

The present invention relates to a propulsion apparatus for a vessel which comprises a main screw and a POD propeller, and in particular comprises a push type POD propeller.

2. Description of the Related Art

Recently, in a propulsion apparatus for a vessel, installation of a POD propeller rearward of a main screw has been proposed in order to add a further propulsive force when the propulsive force generated by the main screw is insufficient.

FIG. 5 shows a conventionally proposed example of a propulsion apparatus for a vessel. In FIG. 5, reference numeral 1 denotes a rear portion of the bottom of the vessel, reference numeral 2 denotes a main screw for generating a main propulsive force for moving the vessel, and reference numeral 10 denotes a push type POD propeller. The main screw is provided so as to rotate by a driving force generated by an engine such as a diesel engine (not shown).

The push type POD propeller 10 used in the above propulsion apparatus is composed of a casing 11, a POD screw 12, a strut 13, and a supporting rod 14.

The casing 11 is formed in a cylindrical shape and the POD screw 12 is provided rearward thereof. The POD screw 12 generates a propulsive force by rotating, and an electric motor (not shown) for driving the POD screw 12 is provided in the casing 11.

The strut 13 has a wing-shaped section and is provided on the upper side of the casing 11, and the supporting rod 14 which acts as a rotational axis of the POD propeller 10 stands upright from the upper end of the strut 13. The supporting rod 14 is connected to a driving mechanism in a hull (not shown), and as a result, the POD propeller 10 is rotatably installed on the rear portion of the bottom of the vessel 1 through the supporting rod 14.

The vessel having the propulsion apparatus for a vessel is moved by the propulsive force obtained by only rotating the main screw 2 or the POD screw 12, or rotating both the main screw 2 and the POD screw 12. Furthermore, when turning the POD propeller 10 around the supporting rod 14, the strut 13 functions as a rudder and a steering force is generated, and as a result; the vessel can be turned.

However, in the conventional propulsion apparatus for a vessel, since the POD propeller 10 is provided rearward of the main screw 2, the propulsive force obtained by the main screw 2 is reduced by the effect of a vortex (hereinafter called "hub vortex") generated on a front end portion of the casing 11 by the main screw 2 itself, and the propulsion efficiency of the main screw 2 is decreased.

Furthermore, when the vessel is moved, a rotating flow remains in a slipstream of the main screw 2. This means that the energy given to the main screw 2 is partly consumed as energy for generating the rotating flow, and a problem occurs in that the propulsion energy of the main screw 2 is decreased.

The present invention is provided in consideration of the above circumstances, and an object of the present invention is to improve the propulsion efficiency of the propulsion apparatus for a vessel by reducing the hub vortex or by utilizing the energy for the rotating flow generated by the main screw.

SUMMARY OF THE INVENTION

In the present invention, the following features are provided in order to solve the above problems.

A first aspect of the propulsion apparatus for a vessel of the present invention comprises a main screw and a push type POD propeller which is provided rearward of the main screw a. A plurality of grooves, which extend along the flow directions of a hub vortex generated by the main screw, are provided on a front end portion of a casing of the POD propeller.

According to the propulsion apparatus for a vessel having the above-described features, the hub vortex generated by the main screw rearward of the main screw is weakened by diffusing the hub vortex along the grooves which are provided on the front end portion of the casing of the POD propeller. Therefore, the propulsion efficiency of the propulsion apparatus for a vessel is improved.

A second aspect of the propulsion apparatus for a vessel of the present invention comprises a main screw and a push type POD propeller which is provided rearward of the main screw, wherein a plurality of stator fins are provided on a front end portion of a casing of the POD propeller.

According to the propulsion apparatus for a vessel having the above-described features, the rotating flow generated by the main screw rearward of the main screw is converted to a propulsive force by the stator fins which are provided on the front end portion of the casing of the POD propeller. Therefore, the propulsion efficiency of the propulsion apparatus for a vessel is improved.

A third aspect of the propulsion apparatus for a vessel of the present invention comprises a main screw and a push type POD propeller which is provided rearward of the main screw, wherein the main screw and POD propeller have the same axes, and a hub portion of the main screw and a front end portion of the POD propeller form a continuous rough spindle shape.

According to the propulsion apparatus for a vessel, having the above-described features, the rotating flow generated by the main screw rearward of the main screw is removed to the outside along the surfaces of the hub portion of the main screw and the front end portion of the POD propeller which form the continuous rough spindle shape. Therefore, the generation of a hub vortex is prevented, and the propulsion efficiency of the propulsion apparatus for a vessel is improved.

A fourth aspect of the propulsion apparatus for a vessel of the present invention comprises a main screw and a push type POD propeller which is provided rearward of the main screw, wherein at least a pair of fins having wing-shaped sections are provided on both sides of a casing of the POD propeller.

According to the propulsion apparatus for a vessel having the above-described features, the rotating flow generated by the main screw rearward of the main screw is converted to a propulsive force by the fins which are provided on both sides of the casing of the POD propeller. Therefore, the propulsion efficiency of the propulsion apparatus for a vessel is improved.

In this case, it is preferable that a leading edge portion of each fin be twisted along the direction of the water flow which is generated by the main screw.

DESCRIPTION OF THE PREFERRED EMBODIMENTS

Preferred embodiments will be presented in the following with reference to FIGS. 1A to 4B. Those parts that are the same as or similar to the conventional parts are given the same reference numbers.

First Embodiment

Figure 1B:
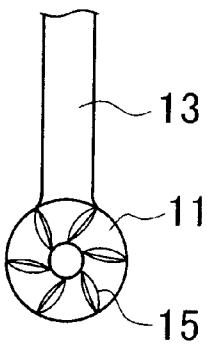
FIG. 1B is a front view of a first embodiment of the propulsion apparatus of the present invention viewed in the direction of the arrows A—A in FIG. 1A.
Figure 1A:
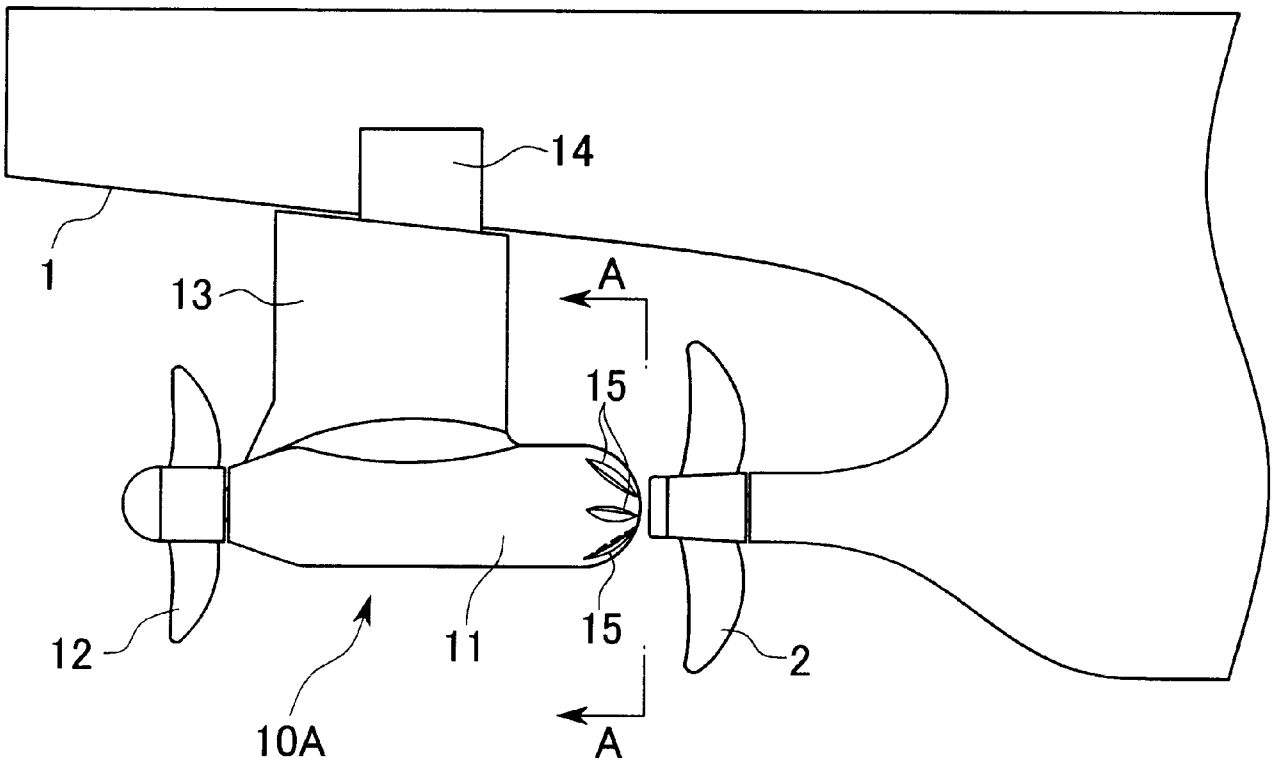
FIG. 1A is a side view of a first embodiment of the propulsion apparatus of the present invention.

FIGS. 1A and 1B show a first embodiment of a propulsion apparatus of the present invention. In these figures, reference numeral 1 denotes a rear portion of the bottom of a vessel, reference numeral 2 denotes a main screw, and reference numeral 10A denotes a push type POD propeller provided rearward of the main screw 2. The propulsion apparatus is composed of the main screw 2 and the POD propeller 10A. In addition, reference numeral 11 denotes a casing, reference numeral 12 denotes a POD screw, reference numeral 13 denotes a strut, and reference numeral 14 denotes a supporting rod.

A plurality of grooves 15 are provided on a front end portion of the casing 11 of the POD propeller 10A. These grooves 15 are provided so as to extend along the flow directions of a hub vortex generated by the rotation of the main screw 2 when the vessel moves forward. That is, the grooves 15 are provided so as to extend along the flow directions of the vortex which is formed at the central part of the rotating flow generated rearward of the main screw 2. In the embodiment shown in the figures, six grooves 15 are provided on the front end portion of the casing 11 along the circumference of the casing 11 at regular intervals, and as shown in FIG. 1B, each groove 15 is inclined to the right side as it extends away from the axis of the casing 11 when the grooves 15 are viewed from the position of the main screw 2.

The number of grooves 15 is not limited to that of the embodiment shown in the figures and can be suitably varied. It is needless to say that the inclined directions of the grooves 15 are reversed when the rotational direction of the main screw 2 for moving the vessel forward is reversed.

According to the propulsion apparatus for a vessel having the above-described features, the rotating flow generated by the rotation of the main screw 2 flows along the grooves 15 and is diffused by the grooves 15. As a result, the hub vortex generated by the rotating flow is weakened and the pressure drop at the low pressure area caused by the hub vortex is reduced. Therefore, the force (resistance) which is generated by the low pressure area and which pulls the hub of the main screw 2 rearward, is reduced, and consequently, the loss of the propulsive force is reduced and the propulsion efficiency of the propulsion apparatus for a vessel is improved.

Second Embodiment

Figure 2B:
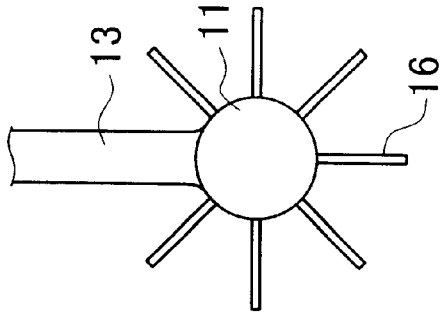
FIG. 2B is a front view of a second embodiment of the propulsion apparatus of the present invention viewed in the direction of the arrows B—B in FIG. 2A.
Figure 2A:
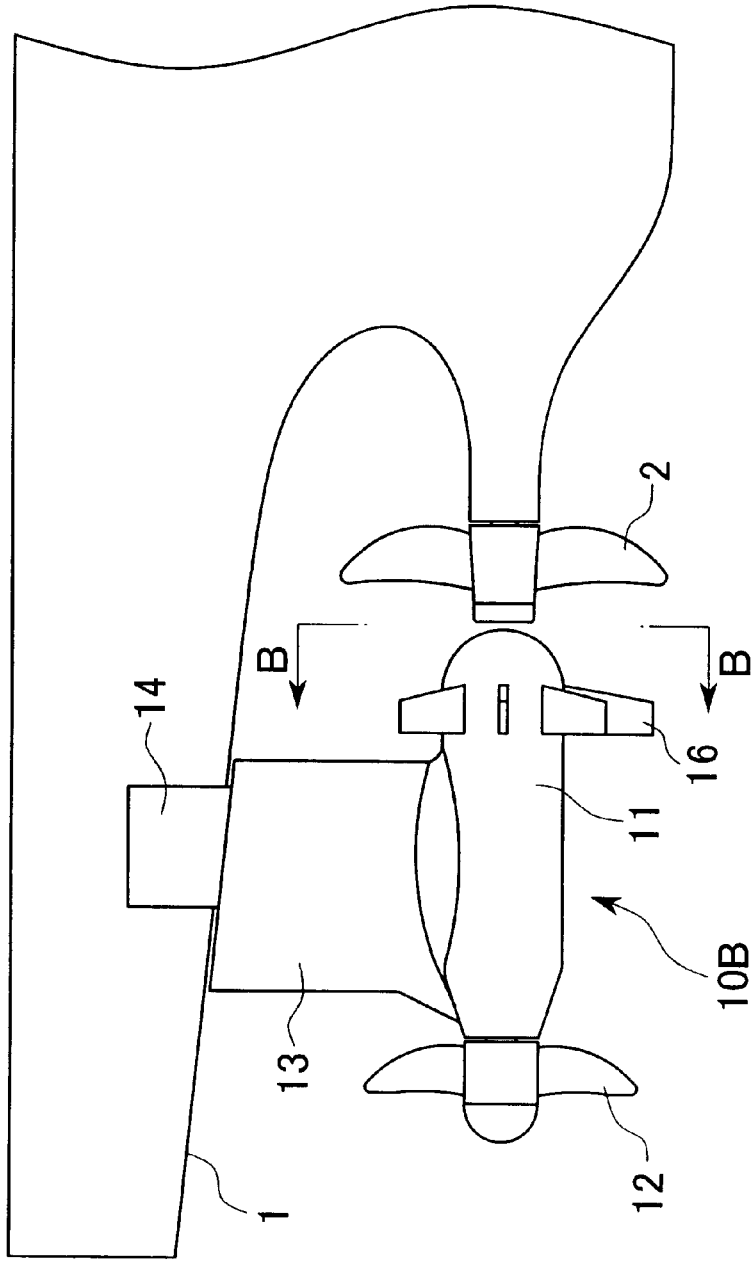
FIG. 2A is a side view of a second embodiment of the propulsion apparatus of the present invention.

FIGS. 2A and 2B show a second embodiment of a propulsion apparatus of the present invention. In these figures, reference numeral 1 denotes a rear portion of the bottom of the vessel, reference numeral 2 denotes a main screw, and reference numeral 10B denotes a push type POD propeller provided rearward of the main screw 2. The propulsion apparatus is composed of the main screw 2 and the POD propeller 10B. In addition, reference numeral 11 denotes a casing, reference numeral 12 denotes a POD screw, reference numeral 13 denotes a strut, and reference numeral 14 denotes a supporting rod.

A plurality of stator fins 16 are provided on a front end portion of the casing 11 of the POD propeller 10B. These stator fins 16 are provided so as to extend along the longitudinal direction of the casing 11. In the embodiment shown in the figures, seven stator fins 16 are provided on the front end portion of the casing 11 along the circumference of the casing 11 at regular intervals, and protrude in the radial direction of the casing 11 as shown in FIG. 2B. However, the number of stator fins 16 is not limited to that of the embodiment shown in the figures, and can be suitably varied.

The stator fins 16 are provided for converting the rotating flow generated by the main screw 2 rearward of the main screw 2 into a propulsive force. The mechanism by which the stator fins 16 convert the rotating flow into the propulsive force is briefly explained below.

The rotating flow is divided into a component which moves directly rearward (toward the POD propeller 10B) along the rotational axis of the main screw 2, and a component which rotates around the rotational axis of the main screw 2. The energy of the former component (hereinafter called "direct energy") acts as the propulsive force of the vessel, however, the energy of the latter component (hereinafter called "rotational energy") does not act as a propulsive force of the vessel and is consequently wasted.

When a plurality of stator fins 16 which protrude in the radial direction of the casing 11 are provided on the front end portion of the casing 11, the rotating flow from the main screw 2 is altered by the stator fins 16 so as to change the flow direction toward the rear side. As a result, the rotational energy which was wasted is converted into the direct energy, and the direct energy which acts as the propulsive force of the vessel is increased. Therefore, the propulsion efficiency of the propulsion apparatus for a vessel is improved.

Note that the output from the POD propeller 10B does not always coincide with that of the main screw 2. When the output from the POD propeller 10B is less than that of the main screw 2, even if the POD screw 12 which rotates in a direction opposite toward the rotational direction of the main screw 2 is employed, the total rotational energy generated by the main screw 2 cannot be utilized by the POD screw 12. In this case, 50% of the rotational energy may be utilized by the stator fins 16, and the remaining 50% of the rotational energy may be utilized by the POD screw 12.

Third Embodiment

Figure 3:
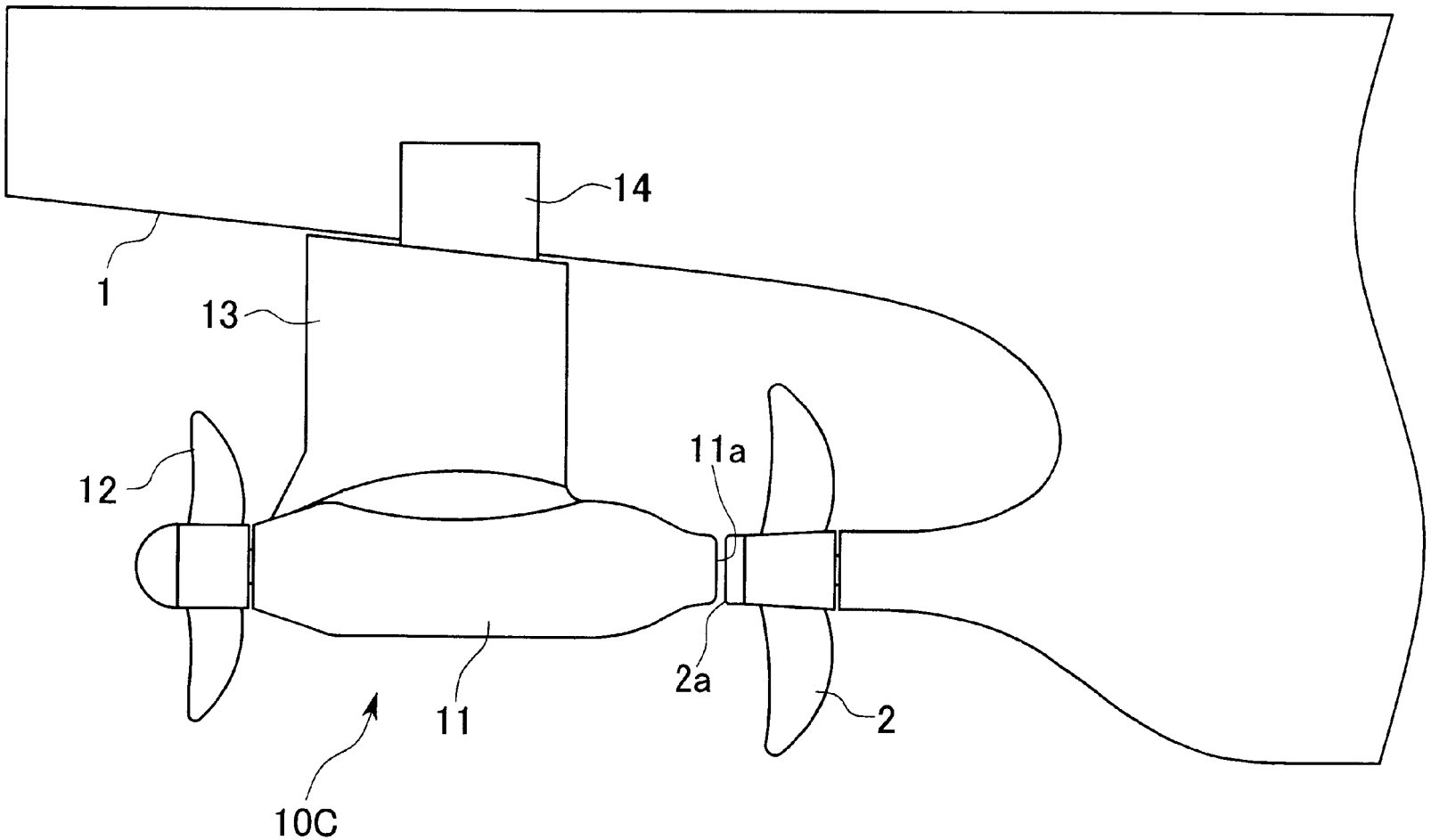
FIG. 3 is a side view of a third embodiment of the propulsion apparatus of the present invention.

FIG. 3 shows a third embodiment of a propulsion apparatus of the present invention. In this figure, reference numeral 1 denotes a rear portion of the bottom of a vessel, reference numeral 2 denotes a main screw, and reference numeral 10C denotes a push type POD propeller provided rearward of the main screw 2. The propulsion apparatus is composed of the main screw 2 and the POD propeller 10C. In addition, reference numeral 11 denotes a casing, reference numeral 12 denotes a POD screw, reference numeral 13 denotes a strut, and reference numeral 14 denotes a supporting rod.

The POD propeller 10C is provided so that the rotational axis (central axis) of the POD screw 12 and the rotational axis of the main screw 2 are the same. Furthermore, a hub portion 2*a* of the main screw 2 and a front end portion of the POD propeller 10C (a front end portion 11*a* of the casing 11) are roughly uniformly continuous and form a rough spindle shape. Here, it is preferable that the space between the hub portion 2*a* and the front end portion 11*a* be minimized as much as possible to maintain the uniformity between the hub portion 2*a* and the front end portion 11*a*.

According to the propulsion apparatus for a vessel having the above-described features, since the main screw 2 and the POD propeller 10C form one substantially continuous body which has a rough spindle shape, the rotating flow generated by the main screw 2 rearward of the main screw 2 is removed to the outside along the surfaces of the casing 11. As a result, the velocity of the slipstream from the main screw 2 which flows into the POD screw 12 becomes slower.

Consequently, since the hub vortex generated in the slipstream is altered, it becomes difficult to generate a hub vortex; the force (resistance) which is generated by the low pressure area caused by the hub vortex and which pulls the hub of the main screw 2 rearward is reduced. Therefore, the loss in the propulsive force is reduced, and the propulsion efficiency of the propulsion apparatus for a vessel is improved.

Fourth Embodiment

Figure 4B:
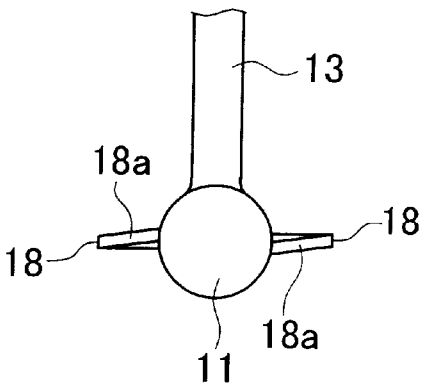
FIG. 4B is a front view of a fourth embodiment of the propulsion apparatus of the present invention viewed in the direction of the arrows C—C in FIG. 4A.
Figure 4A:
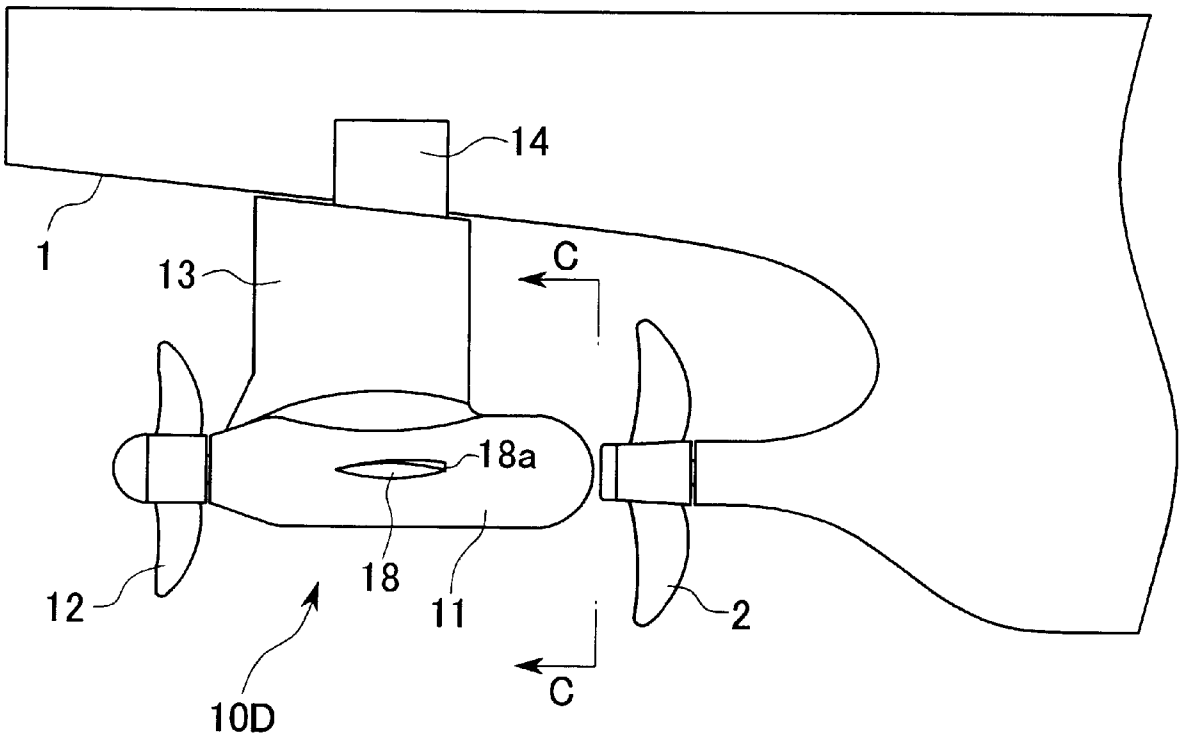
FIG. 4A is a side view of a fourth embodiment of the propulsion apparatus of the present invention.
Figure 5:
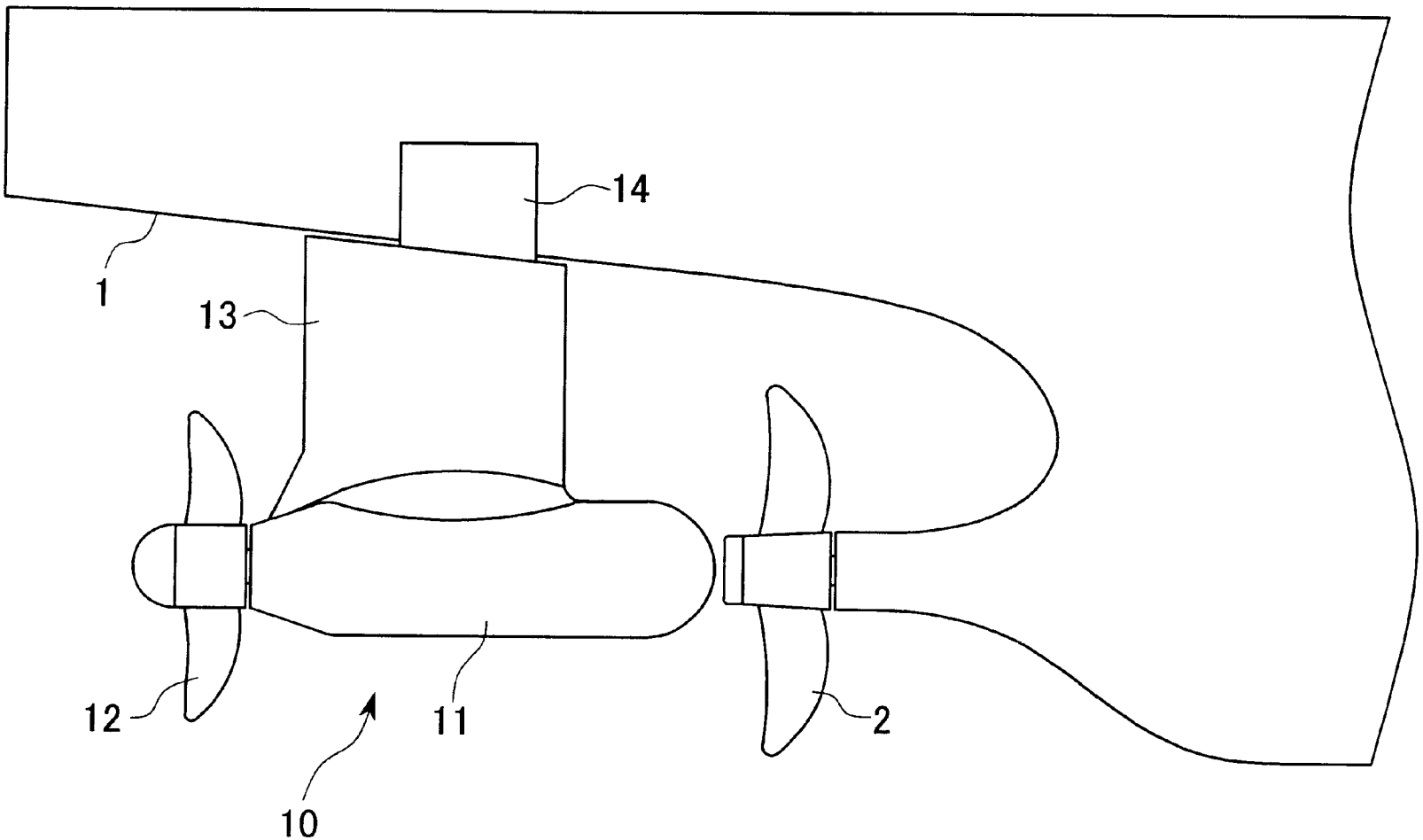
FIG. 5 is a side view of an example of a conventional propulsion apparatus having a POD propeller.

FIGS. 4A and 4B show a fourth embodiment of a propulsion apparatus of the present invention. In these figures, reference numeral 1 denotes a rear portion of the bottom of a vessel, reference numeral 2 denotes a main screw, and reference numeral 10D denotes a push type POD propeller provided rearward of the main screw 2. The propulsion apparatus is composed of the main screw 2 and the POD propeller 10D. In addition, reference numeral 11 denotes a casing, reference numeral 12 denotes a POD screw, reference numeral 13 denotes a strut, and reference numeral 14 denotes a supporting rod.

A pair of fins 18 are provided on the right and left sides of the casing 11 so as to be positioned symmetrically around the axis of the casing 11 and extend horizontally. Each fin 18 has a wing-shaped section, and it is preferable that a leading edge portion 18*a* of each fin 18 be twisted along direction of the water flow (rotating flow) which is generated by the main screw 2.

According to the propulsion apparatus for a vessel having the above-described features, the rotating flow generated by the main screw 2 is converted into a propulsive force by the fins 18 due to a mechanism similar to that of the stator fins 16 described in the second embodiment. Therefore, the propulsion efficiency of the propulsion apparatus for a vessel is improved.

Note that the number of fins 18 of this embodiment is not limited to a pair of fins 18 which are provided on both sides of the casing 11 and which extend horizontally, and two or more fins may be provided on each side of the casing 11 at predetermined angles.

In addition, the features of the present invention are not limited to that of the above-described embodiments, and they can be modified as long as they are within the scope of the present invention.

What is claimed is:

1. A propulsion apparatus for a vessel, comprising:

a main screw;

a push type POD propeller which is provided rearward of said main screw, said POD propeller comprising a casing and a POD screw provided rearward of said casing; and a plurality of grooves provided on a front end portion of said casing of said POD propeller, said plurality of grooves extending along flow directions of a hub vortex generated by said main screw.

2. A propulsion apparatus for a vessel, comprising:

a main screw;

a push type POD propeller which is provided rearward of said main screw, said POD propeller comprising a casing and a POD screw provided rearward of said casing; and a plurality of stator fins provided on only a front end portion of said casing of said POD propeller, said plurality of stator fins being positioned so as to convert rotating flow generated by said main screw into a propulsive force.

3. A propulsion apparatus for a vessel, comprising:

a main screw; and a push type POD propeller which is provided rearward of said main screw, said POD propeller comprising a casing and a POD screw provided rearward of said casing;

wherein said main screw and said POD propeller have the same axes, and wherein a hub portion of said main screw and a front end portion of said casing of said POD propeller form a roughly continuous spindle shape.

4. A propulsion apparatus for a vessel, comprising:

a main screw;

a push type POD propeller which is provided rearward of said main screw, said POD propeller comprising a casing and a POD screw provided rearward of said casing; and at least a pair of fins, positioned on both sides of said casing of said POD propeller, wherein each fin of said at least a pair of fins has a wing-shaped section and a leading edge portion twisted in a direction of water flow generated by said main screw.

* * * * *